US008992241B2

(12) United States Patent
Genest et al.

(10) Patent No.: US 8,992,241 B2
(45) Date of Patent: Mar. 31, 2015

(54) FLEX CIRCUIT BLIND ATTACHMENT APPARATUS AND SYSTEM

(71) Applicant: International Business Machines Corporation, Armonk, NY (US)

(72) Inventors: Robert R. Genest, Poughkeepsie, NY (US); John J. Loparco, Poughkeepsie, NY (US); John G. Torok, Poughkeepsie, NY (US); Wade White, Hyde Park, NY (US)

(73) Assignee: International Business Machines Corporation, Armonk, NY (US)

( * ) Notice: Subject to any disclaimer, the term of this patent is extended or adjusted under 35 U.S.C. 154(b) by 147 days.

(21) Appl. No.: 13/873,735

(22) Filed: Apr. 30, 2013

(65) Prior Publication Data

US 2014/0322946 A1 Oct. 30, 2014

(51) Int. Cl.

| | |
|---|---|
| ***H01R 13/64*** | (2006.01) |
| ***H01R 12/77*** | (2011.01) |
| ***H01R 13/627*** | (2006.01) |
| ***H01R 13/631*** | (2006.01) |

(52) U.S. Cl.

CPC ..... *H01R 12/774* (2013.01); *H01R 13/627* (2013.01); *H01R 13/6315* (2013.01); *Y10S 439/953* (2013.01)

USPC ..... 439/248; 439/953

(58) Field of Classification Search

USPC ..... 439/329, 247, 248, 362, 372, 953

See application file for complete search history.

(56) References Cited

U.S. PATENT DOCUMENTS

| | | | | |
|---|---|---|---|---|
| 3,918,752 | A * | 11/1975 | Leone et al. | 292/174 |
| 4,501,460 | A * | 2/1985 | Sisler | 361/730 |
| 4,828,510 | A * | 5/1989 | Muzslay | 439/352 |
| 5,106,321 | A * | 4/1992 | Haroutel | 439/310 |
| 5,109,453 | A * | 4/1992 | Edwards et al. | 385/90 |
| 5,385,481 | A * | 1/1995 | Kotyuk | 439/378 |
| 5,395,261 | A | 3/1995 | Addison et al. | |
| 5,452,390 | A * | 9/1995 | Bechtel et al. | 385/92 |
| 5,496,181 | A | 3/1996 | Addison et al. | |
| 5,641,299 | A * | 6/1997 | Meguro et al. | 439/347 |
| 5,818,691 | A * | 10/1998 | McMahan et al. | 361/679.43 |
| 5,997,322 | A * | 12/1999 | Kashiyama et al. | 439/157 |
| 6,050,658 | A * | 4/2000 | O'Sullivan et al. | 312/223.1 |
| 6,234,817 | B1 * | 5/2001 | Hwang | 439/247 |
| 6,533,599 | B1 * | 3/2003 | Singleton, Jr. | 439/347 |
| 6,592,387 | B2 * | 7/2003 | Komenda et al. | 439/247 |
| 6,843,657 | B2 * | 1/2005 | Driscoll et al. | 439/65 |
| 6,896,344 | B2 | 5/2005 | Tsutsumi et al. | |
| 6,957,966 | B2 * | 10/2005 | Martin et al. | 439/74 |
| 7,128,474 | B2 * | 10/2006 | Giboney et al. | 385/92 |
| 7,217,144 | B1 | 5/2007 | Cipolla et al. | |
| 7,419,394 | B2 | 9/2008 | Jensen et al. | |
| 7,690,927 | B1 * | 4/2010 | Kerrigan et al. | 439/74 |

(Continued)

*Primary Examiner* — Neil Abrams
*Assistant Examiner* — Travis Chambers
(74) *Attorney, Agent, or Firm* — Cantor Colburn LLP; Margaret McNamara

(57) ABSTRACT

A flex circuit blind attachment apparatus is provided and includes a plate, a fastening member affixable to the plate and configured to draw the plate toward and away from a circuit board and jaws supportively disposed on the plate. The jaws are configured to be opened with the plate being drawn toward the circuit board such that a pin of a flex connector to be connected to the circuit board is released by the jaws following disconnection of the flex connector and the circuit board. The jaws are also configured to capture the pin with the plate being drawn away from the circuit board prior to connection of the flex connector and the circuit board.

20 Claims, 7 Drawing Sheets

(56) References Cited

U.S. PATENT DOCUMENTS

| | | | | |
|---|---|---|---|---|
| 7,731,524 | B2 | 6/2010 | Dittus et al. | |
| 8,257,106 | B2 * | 9/2012 | Fornage et al. | 439/357 |
| 8,292,644 | B2 * | 10/2012 | Hamner et al. | 439/248 |
| 2002/0151207 | A1 | 10/2002 | Bates, III et al. | |
| 2006/0025017 | A1 * | 2/2006 | Sikora et al. | 439/620 |
| 2006/0063434 | A1 | 3/2006 | Bergmann et al. | |
| 2007/0009362 | A1 * | 1/2007 | Tseng | 416/210 R |

* cited by examiner

FLEX CIRCUIT BLIND ATTACHMENT APPARATUS AND SYSTEM

BACKGROUND

The present invention relates to a flex circuit blind attachment apparatus and system.

In computing devices, certain modules are insertible and removable from other computer hardware. In some cases, this hardware includes an enclosure and a bulkhead at the rear of the enclosure that includes a mating connector facing the interior of the enclosure. The modules, meanwhile include flex circuits that connect to the mating connectors behind the modules. Thus, when the modules are inserted into the computing devices, it is often necessary that the connection of the flex circuit and the mating connector be completed blindly.

Since it is necessary for the connection of the flex circuit and the mating connector to maintain a constant pressure in order for the modules to operate reliably, the blindness of the connection procedure can result in non-uniform pressures and other similar connection faults. These issues can lead to malfunctions in the performance of the modules or at least may require time consuming effort at the installation stage.

SUMMARY

According to one embodiment of the present invention, a flex circuit blind attachment apparatus is provided and includes a plate, a fastening member affixable to the plate and configured to draw the plate toward and away from a circuit board and jaws supportively disposed on the plate. The jaws are configured to be opened with the plate being drawn toward the circuit board such that a pin of a flex connector to be connected to the circuit board is released by the jaws following disconnection of the flex connector and the circuit board. The jaws are also configured to capture the pin with the plate being drawn away from the circuit board prior to connection of the flex connector and the circuit board.

According to another embodiment, an apparatus for use with a flex circuit including a connector and a pin and a circuit board including a kicker shaft and a connector is provided. The apparatus includes a plate, a fastening member including a head affixable to the plate and a threaded shaft coupled to the head, the threaded shaft being configured to rotatably register with a threaded through-hole of the circuit board to draw the plate toward and away from the circuit board such that the connectors connect and disconnect and jaws supportively disposed on the plate and configured to be opened by the kicker shaft with the plate being drawn toward the circuit board such that the pin is released by the jaws following disconnection of the connectors and to capture the pin with the plate being drawn away from the circuit board prior to connection of the connectors.

According to yet another embodiment, a flex circuit blind attachment system is provided and includes a flex circuit including a connector and a pin, a circuit board including kicker shaft and a connector and an attachment apparatus comprising a plate, a fastening member affixable to the plate and configured to draw the plate toward and away from a circuit board and jaws supportively disposed on the plate. The jaws are configured to be opened by the kicker shaft with the plate being drawn toward the circuit board such that the pin of the flex circuit is released by the jaws following disconnection of the flex circuit and circuit board connectors. The jaws are also configured to capture the pin with the plate being drawn away from the circuit board prior to connection of the flex circuit and circuit board connectors.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
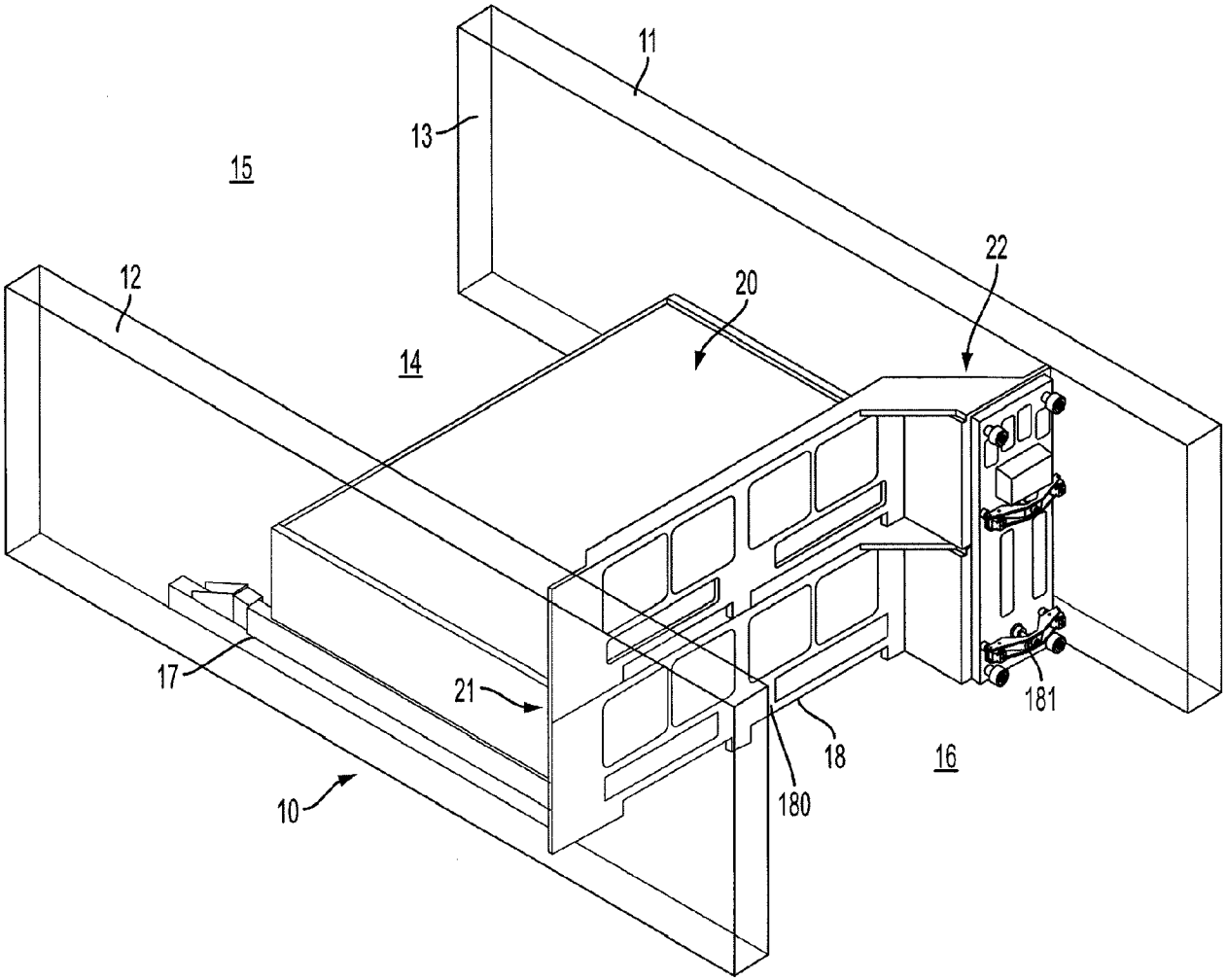
FIG. 1 is a perspective view of a computing device.

The description provided below relates to a flex circuit blind attachment apparatus and system. The apparatus includes a plate 90, a fastening member 100 that is affixable to the plate 90 and configured to draw the plate 90 toward and away from a circuit board 70 and jaws 110 that are supportively disposed on the plate 90. The jaws 110 are configured to be opened with the plate 90 being drawn toward the circuit board 70 such that a push/pull pin 53 of a first connector 50 of a flex circuit 40 that is to be connected to a second connector 74 of the circuit board 70 is released by the jaws 110 following disconnection of the first connector 50 and the second connector 74. The jaws 110 are further configured to capture the push/pull pin 53 with the plate 90 being drawn away from the circuit board 70 prior to connection of the first connector 50 and the second connector 74.

Figure 2:
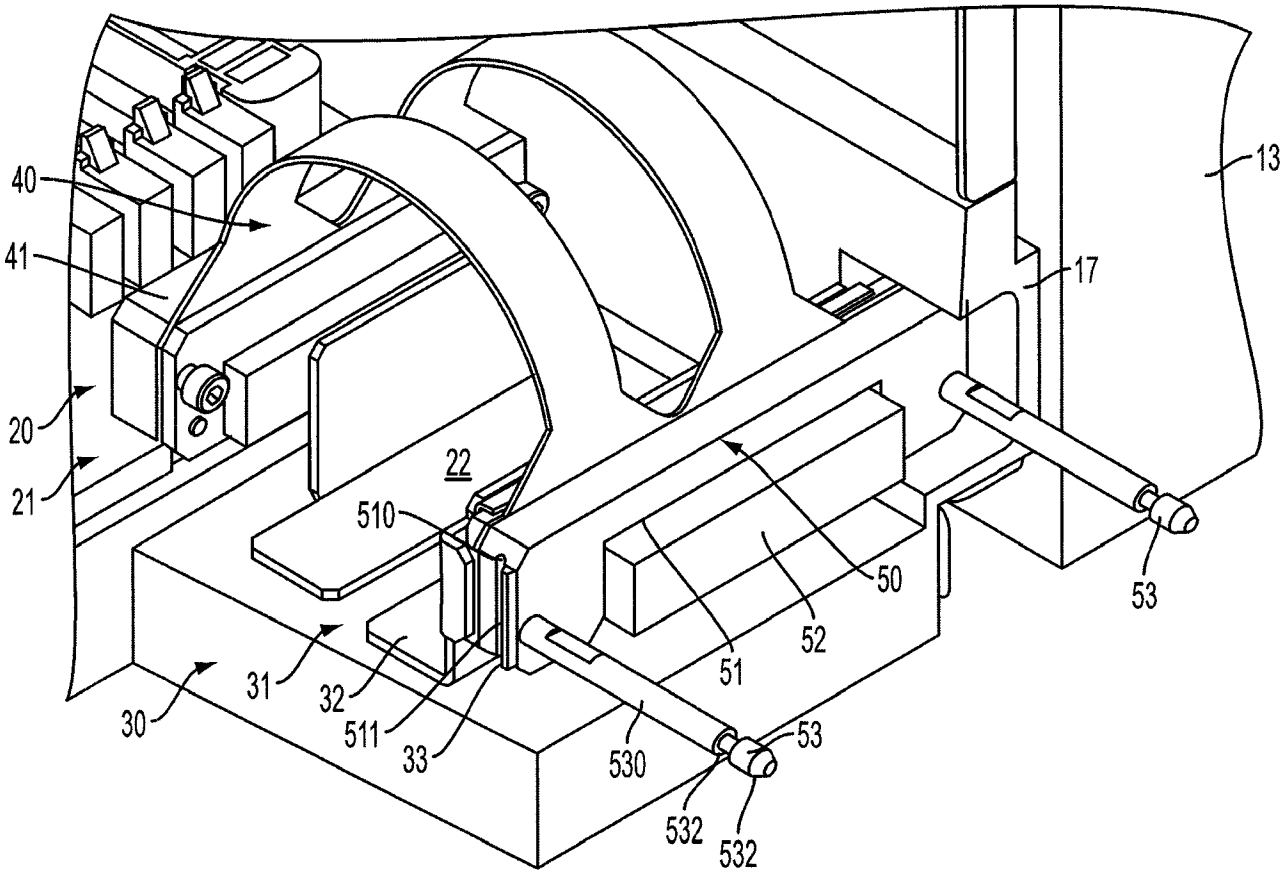
FIG. 2 is an enlarged perspective view of a flex circuit of a module of the computing device.

With reference to FIGS. 1 and 2, a flex circuit blind attachment system 10 is provided for a computing device 11. The computing device 11 includes wall elements 12 and 13 that are opposed to one another and define an interior 14 of the computing device 11, a front portion 15 and a rear portion 16. The front portion 15 is normally accessible by a user whereas the rear portion 16 would face away from the user. Guide rails 17 are provided on interior facing surfaces of the wall elements 12 and 13 and a bulkhead 18 extends between the interior facing surfaces of the wall elements 12 and 13. The bulkhead 18 includes a first portion 180 and a second portion 181 that is recessed from a plane of the first portion 180. The guide rails 17 permit a module 20, such as a hard disk drive, to be installed into the interior 14 such that a rear portion 21 of the module 20 abuts against the first portion 180 of the bulkhead 18. A space 22 is thus defined between the rear portion 21 of the module 20 and the second portion 181 of the bulkhead 18.

As shown in FIG. 2, the one of the guide rails 17 that is adjacent to the space 22 includes a support frame 30 disposed in or just below the space 22. The support frame 30 includes an upward facing surface 31 on which a bracket 32 is affixed. The bracket 32 is formed of an elastic material, such as sheet metal, and includes an elastic claw portion 33.

The module 20 may include a flex circuit 40 and a first connector 50. The flex circuit 40 and the first connector are both disposable in the space 22. The flex circuit 40 extends from a module connector 41, which is disposed in the rear portion 21 of the module 20 and is formed of one or two or more strips of flexible material. The first connector 50 includes a body 51 to which the flex circuit 40 is operably connected, a first connector pin array 52 and push/pull pins 53. The body 51 is generally rigid and is removably insertible into the claw portion 33 whereby the body 51 is elastically responsive to external forces applied thereto. Grooves 510 may be defined in sidewalls of the body 51 to be receptive of corresponding protrusions 511 in the claw portion 33 to aid in the removable insertion of the body 51 into the claw portion 33. The first connector pin array 52 protrudes rearwardly from a rear surface of the body 51 and is configured to be electrically coupled with the module connector 41 via the flex circuit 40. The push/pull pins 53 are provided as a pair of push/pull pins 53 and are disposed on either side of the first connector pin array 52.

Each of the push/pull pins 53 includes a substantially straight tubular element 530 with a tapered distal end 531 and a notch 532 proximate to the distal end 531. This notch 532 has a reduced diameter as compared to the rest of the tubular element 530.

Figure 3:
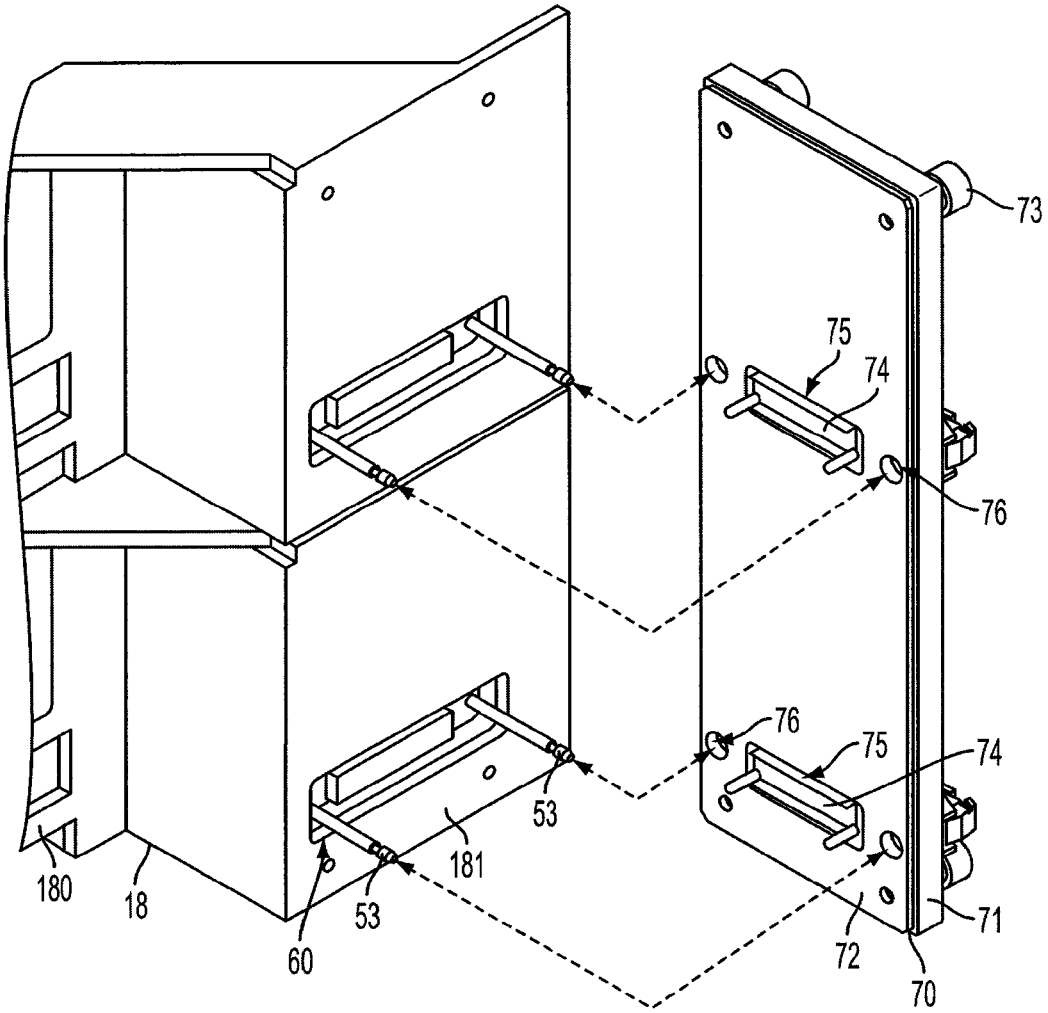
FIG. 3 is an exploded perspective view of normally hidden components of the computing device of FIG. 1.

With reference to FIG. 3, when the module 20 is installed in the interior 14 of the computing device 11 and the body 51 of the first connector 50 is removably inserted into the claw portion 33, the push/pull pins 53 protrude through a through-hole 60 defined in the second portion 181 of the bulkhead 18. This through-hole 60 has a similar shape as but is slightly larger than the first connector 50. As shown in FIG. 3, two modules 20 may be installed in the interior 14 and arranged in a vertical stack with the bulkhead 18 being formed with sufficient height to account for the installation of the upper module 20. In this case, the descriptions provided above and below can be applicable to both the upper module 20 and the lower module 20. However, those descriptions will generally discuss only the lower module 20 for clarity and brevity.

With further reference to FIG. 3, a circuit board 70 is attachable to a rear face of the second portion 181 of the bulkhead 18. The circuit board 70 includes a substrate 71 and a backing plate 72 that is configured to be interposed between the second portion 181 and the substrate 71. Both the substrate 71 and the backing plate 72 are formed to define screw-holes through which fastening elements 73 may be employed to fasten the circuit board 70 to the second portion 181, which is similarly formed to define corresponding screw-holes. In addition, the substrate 71 includes a second connector 74, which is operably receptive of the first connector pin array 52, and the backing plate 72 is formed to define a second through-hole 75. The second connector 74 is positioned in correspondence with the first connector 50 and the second through-hole 75 is positioned in correspondence with the through-hole 60. Thus, when the circuit board 70 is fastened to the second portion 181, the through-hole 60 and the second through-hole 75 align and the first connector 50 and the second connector 74 similarly align for mutual connection.

It is often necessary for the connection of the first connector 50 and the second connector 74 to be made with substantially uniform pressures. These substantially uniform pressures are provided by the attachment apparatus 80 (to be described below) and the action of the push/pull pins 53. To this end, the substrate 71 and the backing plate 72 are further formed to define guide-holes 76 that align with the push/pull pins 53 such that when the circuit board 70 is fastened to the second portion 181, the push/pull pins 53 extend and protrude through the circuit board 70 via the guide-holes 76.

Figure 4:
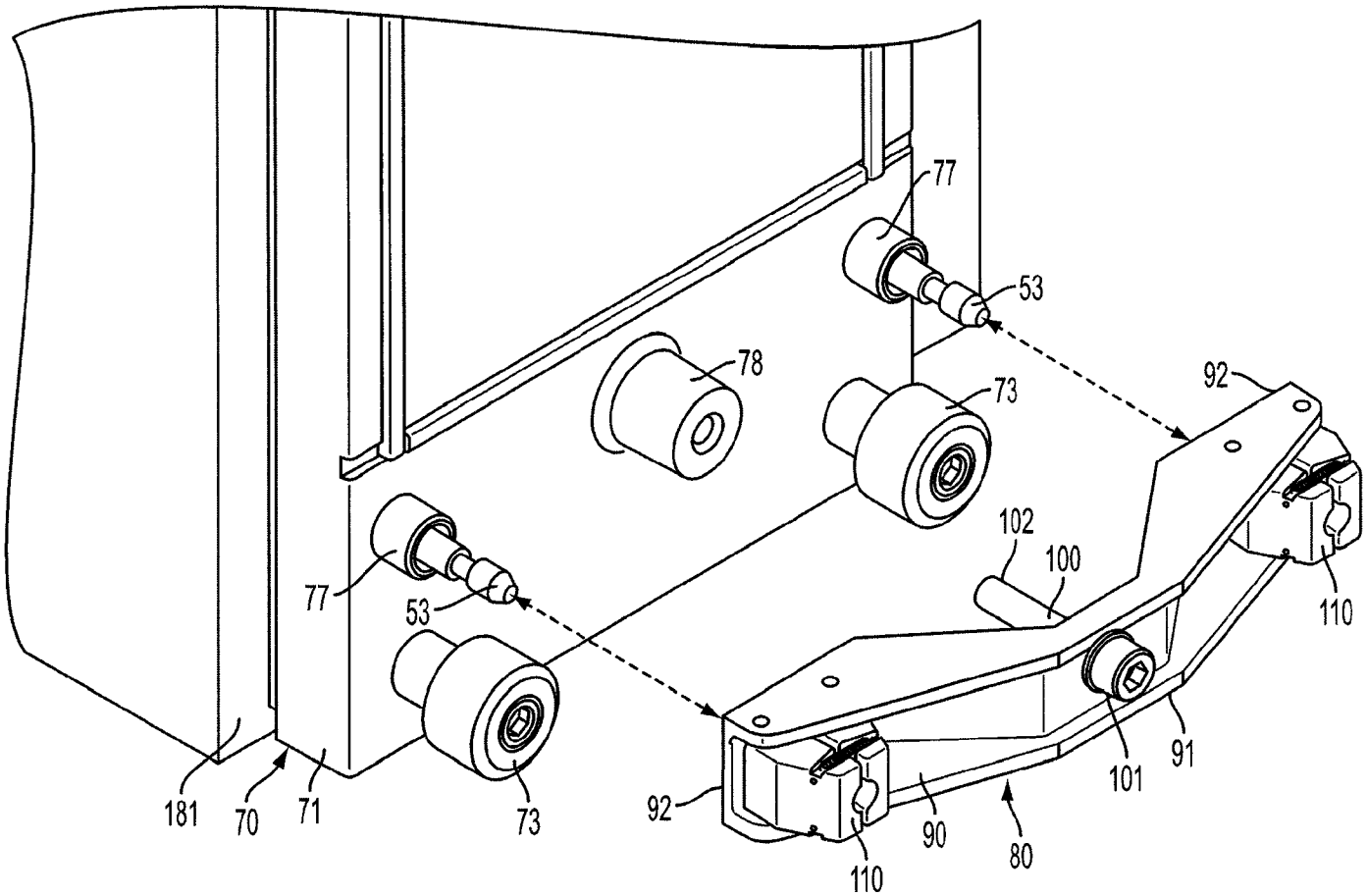
FIG. 4 is an enlarged perspective exploded view of a flex circuit blind attachment apparatus.

With reference to FIG. 4, the substrate 72 further includes kicker shafts 77 and a threaded through-hole 78. The kicker shafts 77 are disposed on either side of the threaded through-hole 78 and correspond in location to the respective locations of the push/pull pins 53 and the guide-holes 76. The kicker shafts 77 protrude from a plane of a rear face of the substrate 71. The kicker shafts 77 may be substantially tubular or slightly tapered and have sufficiently limited length from the plane of the rear face of the substrate 71 such that the distal ends 531, the notches 532 and a portion of the tubular elements 530 of the push/pull pins 53 extend rearwardly out of the kicker shafts 77. The threaded through-hole 78 also protrudes from the plane of the rear face of the substrate 71 but has greater length than the kicker shafts 77.

Figure 5:
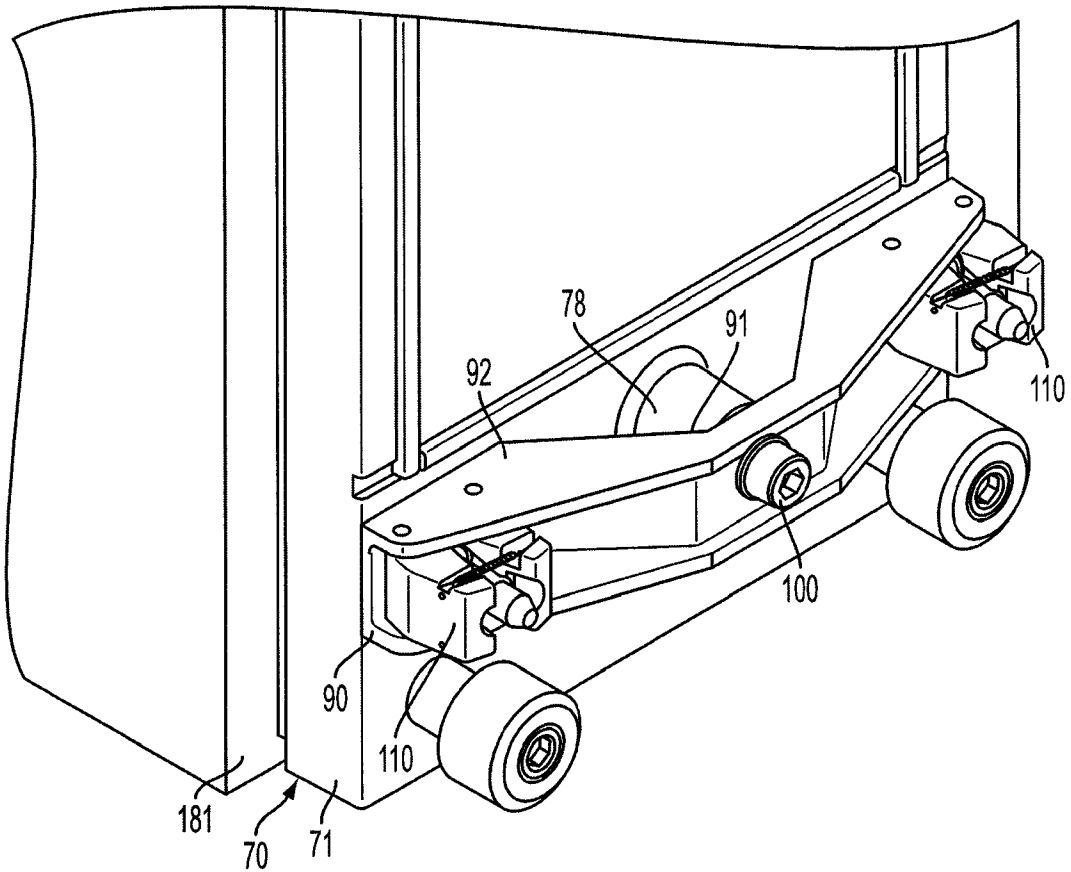
FIG. 5 is an enlarged perspective view of the flex circuit blind attachment apparatus of FIG. 4 at an initial stage of operation.
Figure 6:
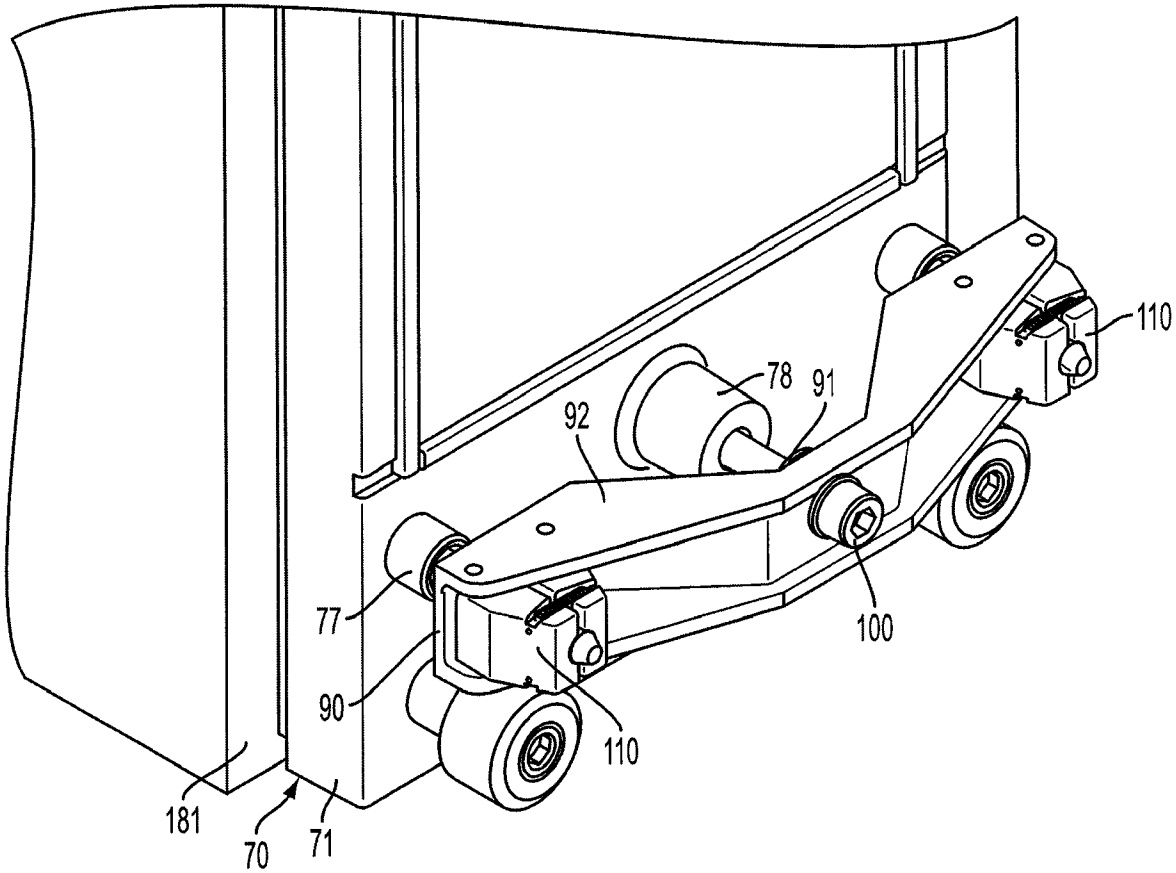
FIG. 6 is an enlarged perspective view of the flex circuit blind attachment apparatus of FIG. 4 at a late stage of operation.
Figure 7:
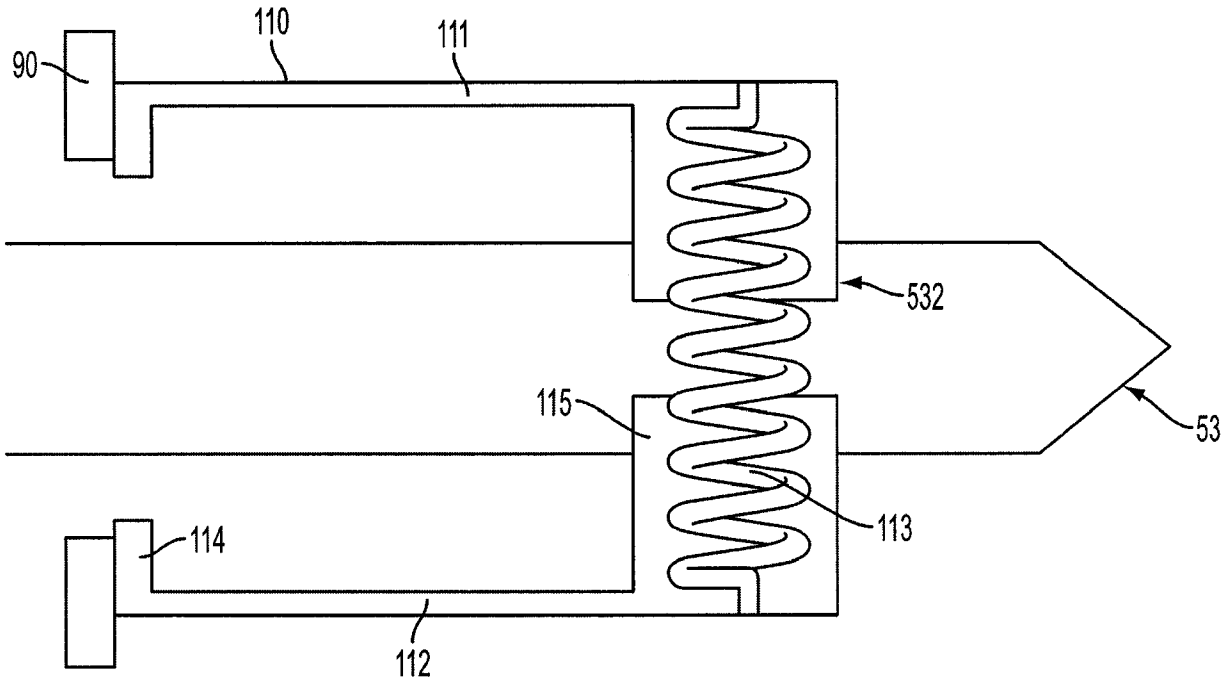
FIG. 7 is a schematic plan view of jaws of the flex circuit blind attachment apparatus of FIG. 4.

With reference to FIGS. 4-6, the flex circuit blind attachment system 10 includes an attachment apparatus 80. The attachment apparatus 80 includes a plate 90, a fastening member 100 that is affixable to the plate 90 and is configured to draw the plate 90 toward and away from the circuit board 70 and a pair of jaws 110 supportively disposed on the plate 90. As discussed below, the pair of jaws 110 are each configured to be opened by the corresponding one of the kicker shafts 77 with the plate 90 being drawn toward the circuit board 70 such that the push/pull pins 53 are each released by the jaws 110 following disconnection of the first connector 50 from the second connector 74. In addition, the jaws 110 are each configured to capture the push/pull pins 53 with the plate 90 being drawn away from the circuit board 70 prior to a connection of the first connector 50 with the second connector 74.

The plate 90 includes a central portion 91, at which the fastening member 100 is affixable to the plate 90, and lateral portions 92 at which the jaws 110 are respectively supportively disposed. The central and lateral portions 91 and 92 are disposed at different planes such that the central portion 91 is recessed from the lateral portions 92 relative to the circuit board 70. The fastening member 100 includes a head 101, which is affixable to the central portion 91 of the plate 90 and a threaded shaft 102 that is fixedly coupled to the head 101. Exterior threading of the threaded shaft 102 registers with corresponding interior threading of the threaded through-hole 78 of the substrate 72. The threading is configured and timed such that the plate 90 is withdrawn from the circuit board 70 as the threaded shaft 102 is rotated in a first (i.e., clockwise or tightening) direction and such that the plate 90 is drawn toward the circuit board 70 as the threaded shaft 102 is rotated in a second (i.e., counterclockwise or loosening) direction.

As shown in FIGS. 4-7, each of the jaws 110 includes an interior jaw portion 111, an exterior jaw portion 112 and an elastic element 113. The elastic element 113 may be provided as a compression spring such that the interior jaw portion 111 and the exterior jaw portion 112 are spring-loaded and biased toward one another to assume a closed position. Each of the respective proximal ends of the interior jaw portion 111 and the exterior jaw portion 112 includes a first inward flange 114. Each of the respective distal ends of the interior jaw portion 111 and the exterior jaw portion 112 includes a second inward flange 115. When the jaws 110 are closed as shown in FIGS. 4, 6 and particularly, 7, the second inward flanges 114 grip onto the notch 532 of the corresponding push/pull pin 53 such that movement of the plate 90 toward and away from the circuit board 70 is accompanied by corresponding movements of the push/pull pins 53 and the first connector 50 as permitted by the bracket 32 and the claw portion 33.

As shown in FIG. 5, the plate 90 has been fully drawn to the circuit board 70. In this position, the fastening member 100 is disposed in its fully loosened position, the recess of the central portion 91 of the plate 90 from the lateral portions 92 is occupied by the threaded through-hole 78 of the substrate 71 and the lateral portions 92 abut the rear surface of the substrate 71. Also, in this position, the kicker shafts 77 penetrate the jaws 110 and interfere with the first inward flanges 114 to thereby force the jaws 110 to remain open in opposition to the bias provided by the elastic element 113.

From the position shown in FIG. 5, the plate 90 may be drawn away from the circuit board 70 by rotation of the threaded shaft 102 of the fastening member 100 in the first direction but the jaws 110 will remain open until the first inward flanges 114 clear the kicker shafts 77. During this time, the push/pull pins 53 and the first connector 50 will not move in a rearward direction along with the plate 90.

As the plate 90 continues to be drawn away from the circuit board 70, the first inwardly flanges 114 will clear the kicker shafts 77 and close around the notches 532 of the push/pull pins 53. At this point, further rotation of the threaded shaft 102 in the first direction will result in a drawing of the plate 90 away from the circuit board 70 and a pulling of the push/pull pins 53 and the first connector 50 in the rearward direction. The effect of the further rotation of the threaded shaft 102 is registered by the fact that the threaded through-hole 78 is longer than the kicker shafts 77, as noted above. The effect leads to the case illustrated by FIG. 6.

As shown in FIG. 6, the plate 90 has been fully drawn away from the circuit board 70. In this position, the fastening member 100 is disposed in its fully tightened position and the first inward flanges 114 have previously cleared the kicker shafts 77 such that the jaws 110 have closed around the notches 532 of the push/pull pins 53. Thus, the first connector 50 has been drawn toward the second connector 74 and the timing of the apparatus has been provided such that, in this position, the first connector 50 is completely mated with the second connector 74. Moreover, the combined effect of the jaws 110 at both the lateral portions 92 provides that the pressures applied to the first connector 50 in the rearward direction are substantially uniform. This results in a substantially reliable connection between the first connector 50 and the second connector 74.

From the position shown in FIG. 6, the plate 90 may be drawn to the circuit board 70 by rotation of the threaded shaft 102 of the fastening member 100 in the second direction. In this case, the jaws 110 will remain closed until the first inward flanges 114 reach the kicker shafts 77. During this time, the push/pull pins 53 and the first connector 50 will be pushed along with the movement of the plate 90 in a forward direction as permitted by the bracket 32 and the claw portion 33 to thereby disconnect the first connector 50 from the second connector 74.

As the plate 90 continues to be drawn to the circuit board 70, the first inward flanges 114 reach the kicker shafts 77 and cause the jaws 110 to open. This action frees the jaws 110 from the notches 532 of the push/pull pins 53 and, at this point, further rotation of the threaded shaft 102 in the second direction will result in continued drawing of the plate 90 to the circuit board 70 but the pushing of the push/pull pins 53 and the first connector 50 in the forward direction will cease. The effect of the further rotation of the threaded shaft 102 leads to the case illustrated by FIG. 5.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

The operations depicted herein are just one example. There may be many variations described therein without departing from the spirit of the invention. For instance, the operations may be performed in a differing order or operations may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A flex circuit blind attachment apparatus, comprising:

a plate;

a fastening member affixable to the plate and configured to draw the plate toward and away from a circuit board; and jaws supportively disposed on the plate, the jaws being configured to be opened with the plate being drawn toward the circuit board such that a pin of a flex connector to be connected to the circuit board is released by the jaws following disconnection of the flex connector and the circuit board, and the jaws being configured to capture the pin with the plate being drawn away from the circuit board prior to connection of the flex connector and the circuit board.

2. The apparatus according to claim 1, wherein the plate comprises:

a central portion, at which the fastening member is affixable to the plate; and a lateral portion, at which the jaws are supportively disposed, the central and lateral portions being disposed at different planes.

3. The apparatus according to claim 1, wherein the pin is provided as a pair of pins and the jaws comprise a corresponding pair of jaws.

4. The apparatus according to claim 1, wherein the jaws are biased to close.

5. The apparatus according to claim 1, wherein the jaws are spring-loaded.

6. The apparatus according to claim 1, wherein the fastening member is configured to register with a threaded through-hole of the circuit board.

7. The apparatus according to claim 6, wherein the threaded through-hole includes a rim protruding from the circuit board.

8. An apparatus for use with a flex circuit including a connector and a pin and a circuit board including a kicker shaft and a connector, the apparatus comprising:

a plate;

a fastening member including a head affixable to the plate and a threaded shaft coupled to the head, the threaded shaft being configured to rotatably register with a threaded through-hole of the circuit board to draw the plate toward and away from the circuit board such that the connectors connect and disconnect; and jaws supportively disposed on the plate and configured to be opened by the kicker shaft with the plate being drawn toward the circuit board such that the pin is released by the jaws following disconnection of the connectors and to capture the pin with the plate being drawn away from the circuit board prior to connection of the connectors.

9. The apparatus according to claim 8, wherein the plate comprises:

a central portion, at which the head is affixable to the plate; and a lateral portion, at which the jaws are supportively disposed, the central and lateral portions being disposed at different planes.

10. The apparatus according to claim 8, wherein the threaded through-hole of the circuit board includes a rim protruding from the circuit board.

11. The apparatus according to claim 8, wherein the pin is provided as a pair of pins and the jaws comprise a corresponding pair of jaws.

12. The apparatus according to claim 8, wherein the jaws are biased to close.

13. The apparatus according to claim 8, wherein the jaws are spring-loaded.

14. A flex circuit blind attachment system, comprising:

a flex circuit including a connector and a pin;

a circuit board including kicker shaft and a connector; and an attachment apparatus comprising a plate, a fastening member affixable to the plate and configured to draw the plate toward and away from a circuit board and jaws supportively disposed on the plate, the jaws being configured to be opened by the kicker shaft with the plate being drawn toward the circuit board such that the pin of the flex circuit is released by the jaws following disconnection of the flex circuit and circuit board connectors, and the jaws being configured to capture the pin with the plate being drawn away from the circuit board prior to connection of the flex circuit and circuit board connectors.

15. The apparatus according to claim 14, further comprising an elastic element on which the flex circuit is supportively disposable.

16. The apparatus according to claim 14, wherein the plate comprises:

a central portion, at which the fastening member is affixable to the plate; and a lateral portion, at which the jaws are supportively disposed, the central and lateral portions being disposed at different planes.

17. The apparatus according to claim 14, wherein the fastening member is configured to register with a threaded through-hole of the circuit board, the threaded through-hole comprising a rim protruding from the circuit board.

18. The apparatus according to claim 14, wherein the pin is provided as a pair of pins and the jaws comprise a corresponding pair of jaws.

19. The apparatus according to claim 14, wherein the jaws are biased to close.

20. The apparatus according to claim 14, wherein the jaws are spring-loaded.

* * * * *